US007070294B2

(12) United States Patent
Patti

(10) Patent No.: US 7,070,294 B2
(45) Date of Patent: Jul. 4, 2006

(54) PAVER LIGHT

(76) Inventor: Anthony Patti, 210 S. Adelaide Ave., Highland Park, NJ (US) 08904

( * ) Notice: Subject to any disclaimer, the term of this patent is extended or adjusted under 35 U.S.C. 154(b) by 0 days.

(21) Appl. No.: 10/757,952

(22) Filed: Jan. 15, 2004

(65) Prior Publication Data

US 2004/0184263 A1 Sep. 23, 2004

Related U.S. Application Data

(60) Provisional application No. 60/440,457, filed on Jan. 16, 2003.

(51) Int. Cl.
*E01F 9/00* (2006.01)

(52) U.S. Cl. ..... 362/153.1; 362/153; 404/24

(58) Field of Classification Search ..... 362/145–153.1; 404/9, 17, 22–24
See application file for complete search history.

(56) References Cited

U.S. PATENT DOCUMENTS 1,853,321 A * 4/1932 Rogers ..... 340/953
2,038,506 A * 4/1936 Cadieux ..... 362/216
3,007,034 A * 10/1961 Reed et al. ..... 362/153
3,824,524 A * 7/1974 Glover ..... 439/282
4,223,377 A * 9/1980 Williams ..... 362/145
4,382,274 A * 5/1983 De Backer et al. ..... 362/153
4,396,972 A * 8/1983 Kaneko et al. ..... 362/145
4,635,167 A * 1/1987 Schlosser ..... 362/85
4,697,950 A * 10/1987 Copeland ..... 404/9
4,744,014 A 5/1988 Harris
4,779,324 A * 10/1988 Sandor, Sr. ..... 29/451
4,912,610 A * 3/1990 Dahlberg ..... 362/153.1
4,931,915 A * 6/1990 Quiogue ..... 362/267
4,974,134 A * 11/1990 Bourne ..... 362/286
4,992,914 A * 2/1991 Heiss et al. ..... 362/153.1
5,029,054 A * 7/1991 Trainor ..... 362/153.1
5,156,454 A * 10/1992 White ..... 362/153
5,160,202 A * 11/1992 Legare ..... 362/153.1
5,335,151 A * 8/1994 Dahlberg ..... 362/153.1
5,390,090 A * 2/1995 Nau ..... 362/153
5,481,443 A * 1/1996 Wagner et al. ..... 362/153.1
5,678,920 A * 10/1997 Kerr ..... 362/145
5,683,170 A * 11/1997 Blaha ..... 362/145
5,743,622 A * 4/1998 Ibbitson et al. ..... 362/153.1
5,778,625 A * 7/1998 Druffel et al. ..... 52/577
5,779,349 A * 7/1998 Reinert, Sr. ..... 362/153.1
5,908,263 A * 6/1999 Conners et al. ..... 404/9
5,924,790 A * 7/1999 Ponton et al. ..... 362/370
5,943,827 A * 8/1999 Okerlund ..... 52/28
5,951,144 A 9/1999 Gavigan et al.

(Continued)

*Primary Examiner*—Alan Cariaso
*Assistant Examiner*—Jason Han
(74) *Attorney, Agent, or Firm*—McCarter & English, LLP

(57) ABSTRACT

A paver light having a masonry structure with an aperture that has a substantially constant diameter from an exterior surface to an interior surface of the masonry structure, and a lighting fixture positioned within the aperture of the masonry structure. The lighting fixture includes a support member with an internal cavity, an electrical socket removably received within the cavity of the support member, and a modular light assembly removably mounted to the support member. The modular light assembly is releasably connected to the socket such that the socket is removed from the cavity of the support member as the modular light assembly is removed from the support member. Upon removal of the modular light assembly from the support member, the modular light assembly can be disconnected from the socket for the purposes of repair or replacement externally of the masonry structure.

25 Claims, 10 Drawing Sheets

U.S. PATENT DOCUMENTS 6,027,280 A * 2/2000 Conners et al. ..... 404/19
6,065,853 A * 5/2000 Crevier ..... 362/152
6,068,384 A * 5/2000 Tyson et al. ..... 362/153.1
6,179,435 B1 * 1/2001 Wilson ..... 362/147
6,231,206 B1 5/2001 Hervey et al.
6,334,695 B1 * 1/2002 Abe et al. ..... 362/153.1
6,547,589 B1 * 4/2003 Magyar et al. ..... 439/535
6,565,239 B1 * 5/2003 Rizkin et al. ..... 362/373
6,648,546 B1 * 11/2003 Abe et al. ..... 404/12
6,665,986 B1 * 12/2003 Kaplan ..... 52/102
2003/0048634 A1 * 3/2003 You et al. ..... 362/153.1
2003/0156405 A1 * 8/2003 Kim ..... 362/153.1
2004/0252489 A1 * 12/2004 Hagen ..... 362/153.1

* cited by examiner

PAVER LIGHT

CROSS-REFERENCE TO RELATED APPLICATION

This application is a §111(a) application relating to commonly owned U.S. Provisional Application Ser. No. 60/440,457, entitled "Paver Light" filed Jan. 16, 2003.

FIELD OF THE INVENTION

The present invention relates to a light for use in interlocking concrete paving stones, commonly referred to as "pavers", and similar building components used to make driveways, walkways and patios.

BACKGROUND OF THE INVENTION

With the advent of cured concrete brick pavers, their use in home architecture, industrial architecture and landscaping has proliferated. Numerous styles and sizes of pavers and interlocking paver systems have been developed in order to enhance the functioning, as well as the aesthetics, of paver systems. Some paver systems include a method and apparatus for planning and installing pavers to achieve the maximum aesthetic effect, as well as the greatest functional value.

In providing an illuminated paver, there are special considerations that need to be addressed. One consideration relates to the strength of the paver for vehicle support. Another consideration relates to water drainage, since water and condensation may fill the inside of an electrical apparatus, thereby damaging the electrical apparatus, or presenting a shock hazard among other undesirable consequences. As a result, an illuminated paver must be strong and provide a waterproof housing or enclosure to hold the electrical components inside, thereby providing a durable, long lasting product.

Illuminated pavers have been developed previously (see, for example, U.S. Pat. Nos. 5,390,090; 5,678,920 and 6,027,280). It is noted that while the devices disclosed in the foregoing patents are designed to fit in place of a paver and provide light, none are actually masonry-based pavers. Notably, none of the pavers that are the subject of the foregoing patents has the inherent strength, color or texture of the masonry paver that it replaces.

One problem encountered with current illuminated pavers is that of vertical support. Normally vertical support is provided to each interlocking concrete brick paver from an adjacent such paver by the vertical face thickness of the adjacent paver. Typically, the vertical face of such pavers is within a range between approximately 2⅜ inches to 3⅛ inches or greater in height. This vertical thickness allows each paver to move slightly in a vertical direction, without significant tilting, when the paver is under load, such as when a vehicle rolls over it. This inherent feature of concrete pavers allows a load to be shared among adjacent pavers. The problem associated with other geometric-shaped non-concrete illuminated pavers occurs because the lens portion of such an illuminated paver overhangs the cast plastic body of the illuminated paver, precluding the vertical faces of other pavers from providing support to the illuminated paver.

Another type of illuminated paver includes a concrete paver with a small fiber optic light source. The fiber optics that are housed within such pavers are generally fragile and susceptible to breakage. The glass lens of the light source is also susceptible to damage by snow chains, studded tires and the like, which are on the vehicles rolling over them. A damaged fiber optic component may require substantial time and expense to effect a repair. For instance, a broken fiber optic line may require that an entire length or "run" of fiber optic line be replaced, which may further require a section of buried cable to be dug up. This procedure can be both difficult and expensive. Furthermore, the amount of light provided by such fiber optic paver lights is usually inadequate to sufficiently illuminate the paved area.

Additional issues that have arisen in relation to illuminated pavers include the power source and power consumption. High voltage, alternating current (commonly referred to as "AC") is generally avoided for outdoor applications such as paver lights because of the risk of shock due to water infiltration. Complicated grounding procedures to reduce the risk of shock are required when using AC current and as such, deter the use of AC powered illuminated pavers.

Low voltage applications for illuminated pavers, on the other hand, have been in use for some time. For example, U.S. Pat. No. 6,027,280 discloses a light powered by a 12-volt direct current (commonly referred to as "DC"). DC powered lights for pavers require only a small amount of power and, thus, there is little risk of electric shock due to water infiltration and grounding assurances are not needed.

U.S. Pat. No. 5,951,144 to Gavigan (the "Gavigan '144 patent") discloses a low voltage lighting system that includes a brick having an upper surface and a lower surface opposite thereof, and a bore extending from the upper surface to the lower surface. The bore includes a countersunk enlargement located proximate to the upper surface of the brick. As disclosed in the Gavigan '144 patent, the countersunk enlargement is substantially larger in shape and size than that of the remaining portion of the bore. This enables the brick to accommodate the particular structure of a modular light assembly disclosed therein. However, the problem with this configuration is that drilling and boring the countersunk enlargement and the remaining portion of the bore is difficult and time consuming, requiring careful and close attention to boring depth so as to allow the modular light assembly to sit flush with the upper surface of the brick. Moreover, if the lighting system disclosed in the Gavigan '144 patent is to be mass produced, it would be very difficult to mold a brick with a bore having a countersunk enlargement then to simply produce a brick with an equal sized bore all the way through it. Finally, the drilling and boring of the bore having the countersunk enlargement is facilitated by a proprietary drill bit, which is only available from a company identified as In-Lite Design Corporation of Ontario, Canada. As a result, any individual or company that may be interested in selling or installing the lighting system covered by the Gavigan '144 patent must first obtain separate drill bits (both original and replacement bits) from In-Lite, thereby increasing the expense for producing the lighting system disclosed therein.

SUMMARY OF THE INVENTION

The present invention overcomes the disadvantages and shortcomings of the prior art discussed above by providing a new and improved paver light. The paver light includes a masonry base having an exterior surface, an interior surface opposite the exterior surface, and an aperture that extends through the base from the exterior surface to the interior surface. The aperture has a substantially constant diameter from the exterior surface to the interior surface of the base. A tubular-shaped support sleeve is positioned within the aperture of the base. The support sleeve provides structural support for a modular light assembly removably mounted to one end thereof proximate to the exterior surface of the base. More particularly, the modular light assembly includes a cam lock that corresponds with and engages cam lock tabs of a mounting bracket that is mounted to the support sleeve. This configuration allows a user to easily install and remove the modular light assembly by turning it relative to the mounting bracket. Alternatively, the modular light assembly can be mounted to the support sleeve by an adhesive, which acts as a seal to prevent debris from entering into the interior of the support sleeve and making contact with the components contained therein.

In accordance with another aspect of the present invention, an electrical socket is removably received within the cavity of the support member. The modular light assembly is releasably connected to the socket such that the socket is removed from the cavity of the support member as the modular light assembly is removed from the support member. As a result, the modular light assembly can be disconnected from the socket for the purposes of repair or replacement externally of the masonry structure.

In accordance with another aspect of the present invention, the paver light includes a support plate positioned adjacent to the interior surface of the base. When the paver light is installed, the plate impedes the support sleeve from exiting the aperture of the base at its interior surface and into a bedding substrate. As a result, the modular light assembly is prevented from recessing too far below the exterior surface of the base.

Specifically, the present invention has been adapted for use as a component of driveways, walkways and patios. However, the present invention can be utilized as a component for other structures. Further features and advantages of the invention will appear more clearly on a reading of the detailed description of the exemplary embodiments of the invention, which are given below by way of example only with reference to the accompanying drawings.

BRIEF DESCRIPTION OF THE DRAWINGS

For a better understanding of the present invention, reference is made to the following detailed description of the exemplary embodiments considered in conjunction with the accompanying drawings, in which.

DETAILED DESCRIPTION OF THE DRAWINGS

Figure 1:
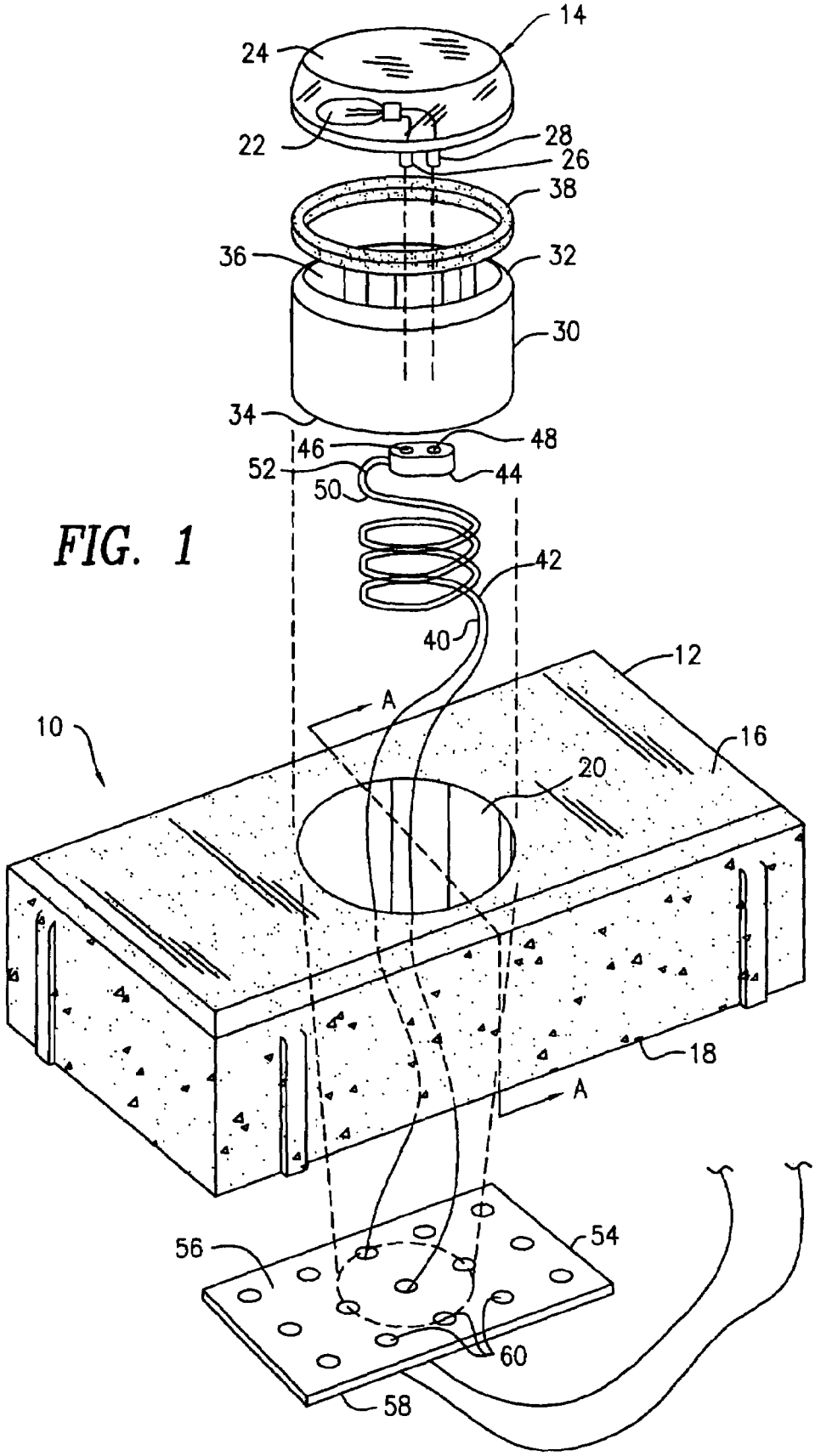
FIG. 1 is an exploded perspective view of a paver light constructed in accordance with one exemplary embodiment of the present invention.
Figure 2:
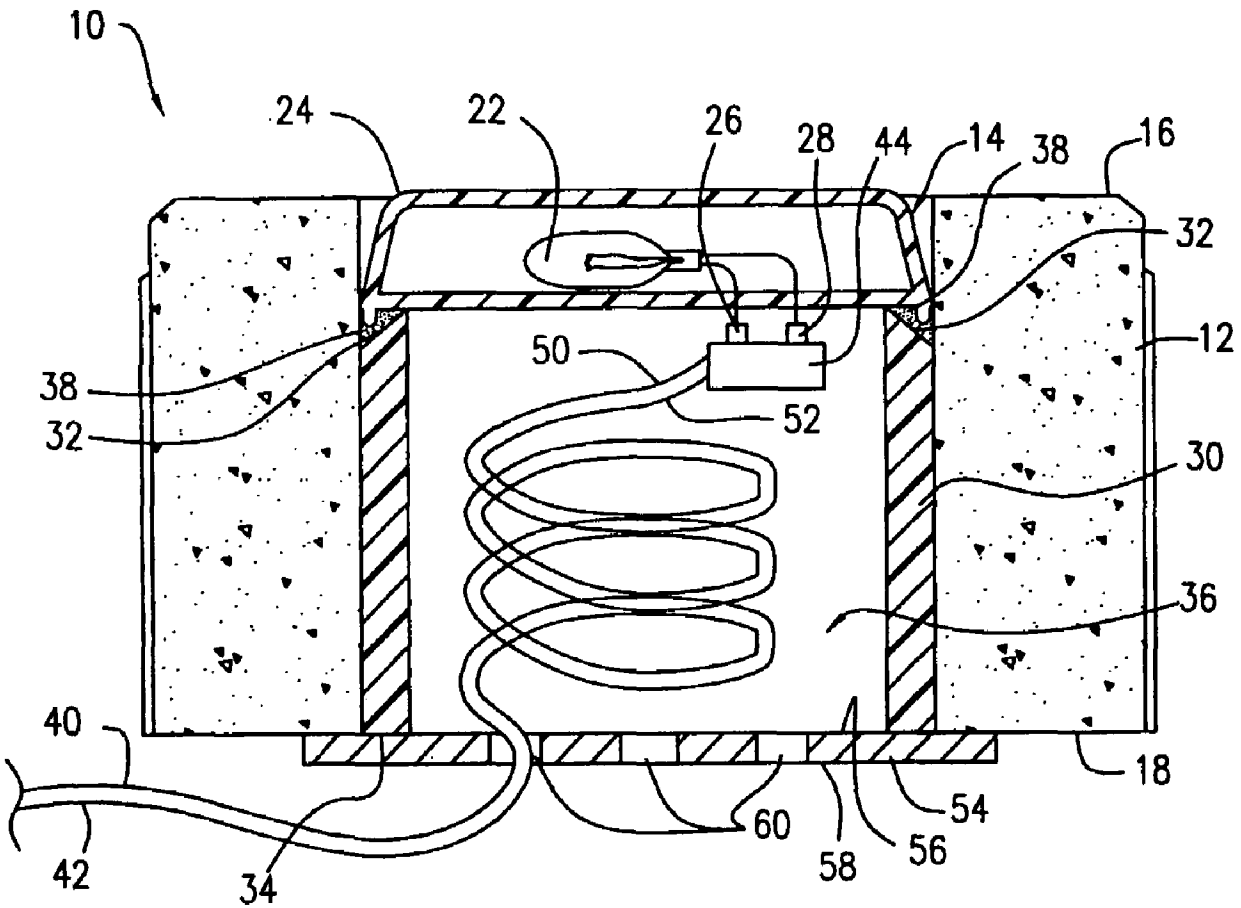
FIG. 2 is a cross-sectional view, taken along section line A—A and looking in the direction of the arrows, of the paver light shown in FIG. 1.

Referring to FIGS. 1 and 2, a paver 10 includes a rectangular brick-shaped base 12 and a disc-shaped modular light assembly 14, whose features and function shall be described hereinafter. The base 12 includes an exterior surface 16 and an interior surface 18 opposite the exterior surface 16. A circular-shaped aperture 20 extends longitudinally from the exterior surface 16 to the interior surface 18 of the base 12. The aperture 20 is sized and shaped to accommodate the receipt of the light assembly 14 and other components of the paver 10 within the base 12, which shall be identified and described in more detail below.

Still referring to FIGS. 1 and 2, the light assembly 14 includes an incandescent bulb 22, a disc-shaped lens cap 24 which shields the bulb 22, and a pair of plug-like connectors 26, 28. The lens cap 24 is preferably waterproof and substantially transparent. Alternatively, the lens cap 24 can consist of different colors and/or can be modified to an opaque frosted finish (for instance, by sanding it with sandpaper) for aesthetic appeal. Preferably, the candlepower of the bulb 22 is sufficient to illuminate a driveway, walkway, patio or stairway in which the paver 10 is installed. Alternatively, other light sources, such as, for example, a light emitting diode ("LED") (not shown in FIGS. 1 and 2) may be used in place of the bulb 22.

Still referring to FIGS. 1 and 2, the paver 10 includes a tubular-shaped support sleeve 30 having a first end 32, a second end 34 opposite the first end 32, and a centrally located cylindrical-shaped cavity 36 located between the first end 32 and the second end 34. The first end 32 of the support sleeve 30 is preferably tapered (as shown in FIGS. 1 and 2), but it need not be. The light assembly 14 is removably mounted to the first end 32 of the support sleeve 30 by an adhesive 38. The adhesive 38 may be, but is not limited to, materials commonly known in the art as "electricians putty" or "pavement adhesive", which, while providing a flexible watertight seal, may be removed if necessary. The support sleeve 30 is removably installed within the aperture 20 of the base 12 such that the first end 32 of the support sleeve 30 is recessed from the exterior surface 16 of the base 12 and the light assembly 14 is positioned proximate to the exterior surface 16 of the base 12.

Still referring to FIGS. 1 and 2, a pair of electrical wires 40, 42 passes under the interior surface 18 of the base 12 and enters the cavity 36 of the support sleeve 30. The wires 40, 42 supply low voltage current to the light assembly 14. A socket 44 having a pair of receptacles 46, 48 (not shown in FIG. 2, but see FIG. 1) is connected at one end 50 of the wire 40 and at one end 52 of the wire 42. Preferably, dielectric grease (not shown in FIGS. 1 and 2) is disposed on and around the receptacles 46, 48 to prevent corrosion of the socket 44. The connectors 26, 28 of the light assembly 14 mate respectively with the receptacles 46, 48 of the socket 44. The wires 40, 42 are preferably coiled inside the cavity 36 of the support sleeve 30. In this regard, the wires 40, 42 have a predetermined length that allows for the removal of the light assembly 14 and the socket 44 from the support sleeve 30 for the purposes of repair or replacement of the light assembly 14 externally of the base 12.

Still referring to FIGS. 1 and 2, the paver 10 includes a rectangular-shaped support plate 54 having a first surface 56 and a second surface 58 opposite thereof. The function of the plate 54 shall be described hereinafter. A plurality of circular-shaped holes 60 extend longitudinally from the first surface 56 to the second surface 58 of the plate 54. The first surface 56 of the plate 54 engages the interior surface 18 of the base 12 and substantially obstructs the aperture 20 of the base 12. The plate 54 may be attached to the base 12, but it need not be. In this configuration, the second end 34 of the support sleeve 30 engages the first surface 56 of the plate 54.

It is noted that the base 12 preferably consists of a rectangular-brick shape, but it can consist of other shapes and sizes. The plate 54 is preferably rectangular in shape, but it can consist of other shapes and sizes. While the aperture 20 of the base 12 and the cavity 36 of the support sleeve 30, are each preferably cylindrical in shape, it should be noted that each can consist of other shapes and sizes. Also, the holes 60 of the plate 54 are each preferably circular in shape, but each can consist of other shapes and sizes. In addition, the light assembly 14 is preferably disc-shaped, but it can consist of other shapes and sizes. Finally, the support sleeve 30 is preferably tubular in shape, but it can consist of other shapes and sizes.

It is also noted that the base 12 is preferably manufactured from a masonry material, such as poured concrete or fired clay type building brick. Alternatively, the base 12 can be manufactured from other materials. In addition, the lens cap 24 of the light assembly 14 is preferably made from high impact polycarbonate, but it can be made from other materials. The support plate 54 is preferably manufactured from a thin flexible corrosion resistant material, such as galvanized steel, or from aluminum. Alternatively, the support plate 54 can be manufactured from other materials. Finally, the support sleeve 30 is preferably manufactured from PVC pipe, but it can be manufactured from other materials.

Moreover, a suitable light assembly 14 may be obtained commercially from Truck-Lite Inc., of Falconer, N.Y., model number 10, part number 10202. Alternatively, the light assembly 14 can be supplied by other manufacturers and/or be characterized by other model and part numbers.

In preparation for use of the paver 10, the light assembly 14 is connected to the socket 44 externally of the base 12. More particularly, the connector 26 of the light assembly 14 is connected to the receptacle 46 of the socket 44, while the connector 28 of the light assembly 14 is connected to the receptacle 48 of the socket 34. An end of the wire 40 opposite the end 50 thereof and an end of the wire 42 opposite the end 52 thereof are each connected to a power supply (not shown in FIGS. 1 and 2). The power supply has a preferable voltage of 12 volts, but it may have another voltage. Each of the wires 40, 42 are fed through one of the holes 60 of the support plate 54. Alternatively, the wires 40, 42 may be fed through an opening formed between an edge of the plate 54 and the aperture 20 of the base 12 (not shown in FIGS. 1 and 2).

The plate 56 acts as a stop to prevent the support sleeve 30 from being pressed into a bedding substrate (not shown in FIGS. 1 and 2) that the paver 10 is laid on, in the event that a force is applied directly on top of the light assembly 14. In turn, the light assembly 14 is prevented from traveling too far below the exterior surface 18 of the base 12; and, therefore, allows the light assembly 14 to support vertical loading.

Because the paver 10 is designed for installation within an area populated with other pavers, the light assembly 14 is configured to be removed from the base 12 without having to remove any of the other pavers (not shown in the Figures). More particularly, the light assembly 14 may be removed from the paver 10 with a common screwdriver or similar implement by simply prying the light assembly 14 out of the aperture 20 of the base 12. In this regard, the light assembly 14 can be quickly and easily disconnected from the socket 44 externally from the base 12 and replaced with a new light assembly 14 and reinstalled into the base 12. Furthermore, because the light assembly 14 is preferably manufactured as a sealed modular unit, replacement of the entire light assembly 14 is possible, thus gaining a new light source and housing.

In addition, the base 12 may be supplied with the light assembly 14 in the form of a kit or the base 12 may be acquired separately and modified at the construction site from preexisting masonry block. If supplied with the light assembly 14 in a kit, the aperture 20 in the base 12 may be pre-cast or otherwise formed therein during manufacture of the masonry block. If a masonry block is to be modified at the construction site to accept the light assembly 14, the aperture 20 in the base 12 may be created through the masonry block using commonly available tools such as drills or drill presses. One tool that may be used to create the aperture 20 is a diamond tipped piloted core bit used in combination with a drill or drill press. The piloted core bit creates the aperture 20 by boring a hole straight through the masonry block.

Figure 3:
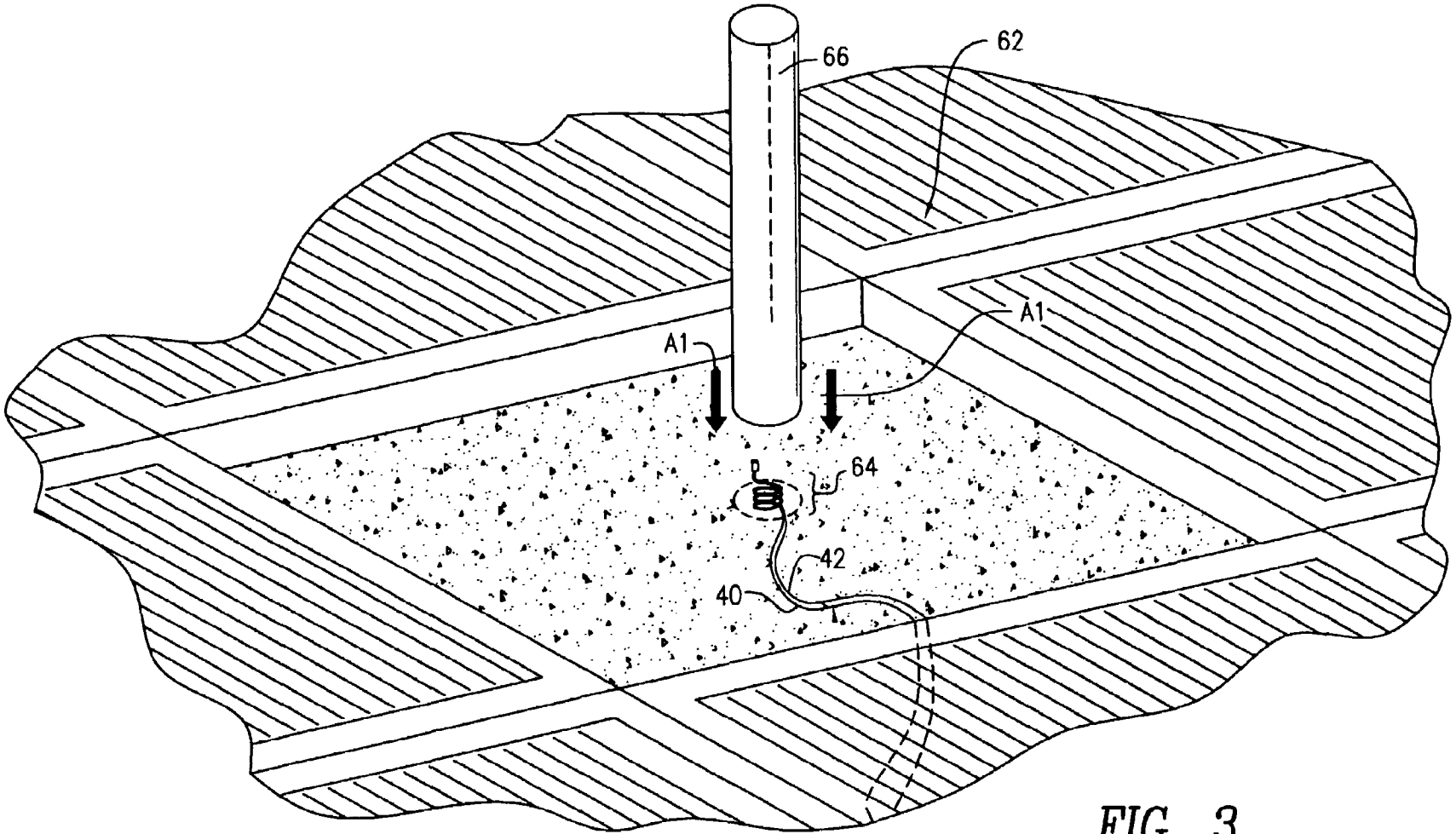
FIGS. 3, 4 and 5 are sequential perspective views of the steps of an exemplary method of constructing the paver light shown in FIGS. 1 and 2.
Figure 4:
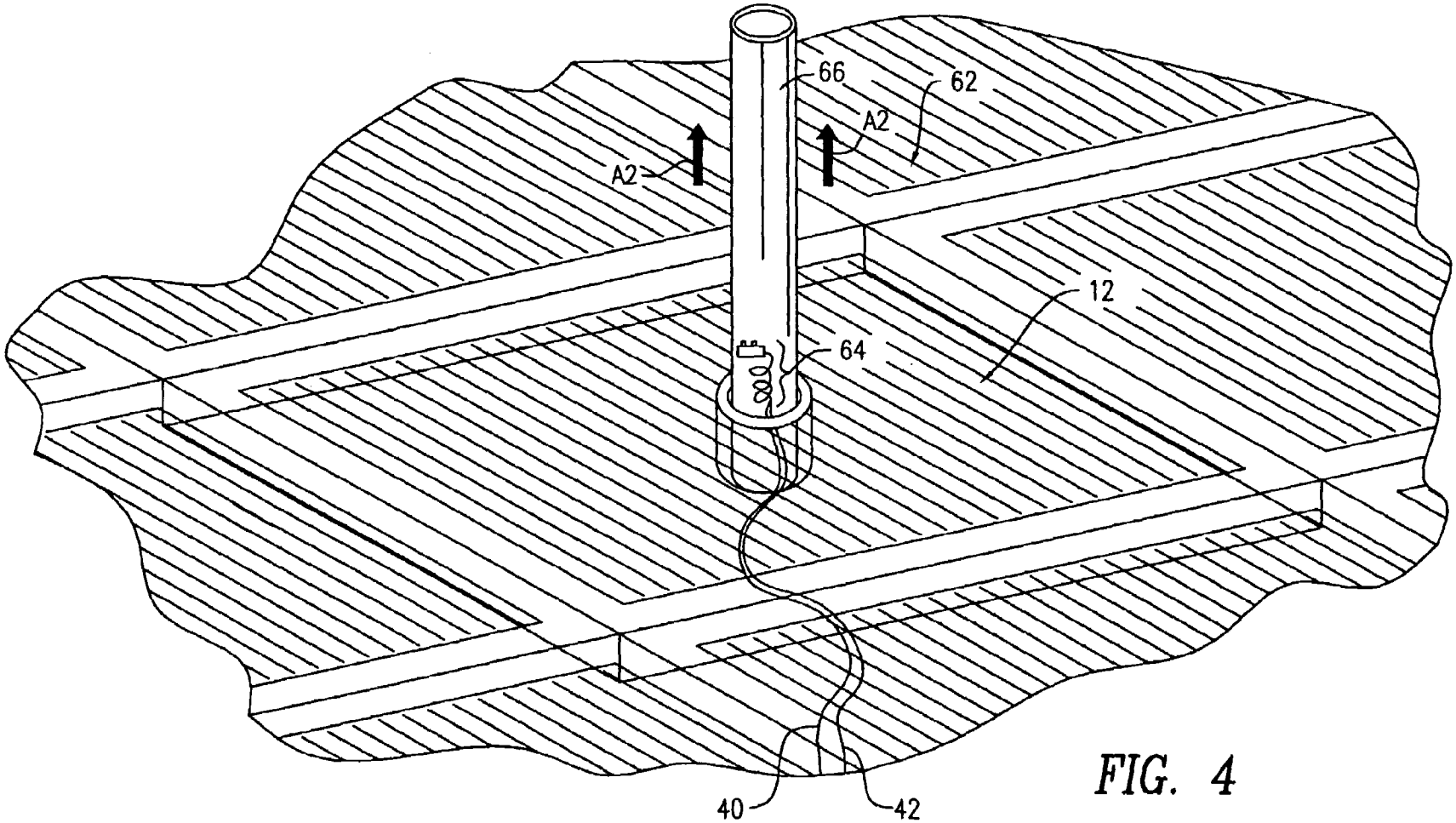
Figure 5:
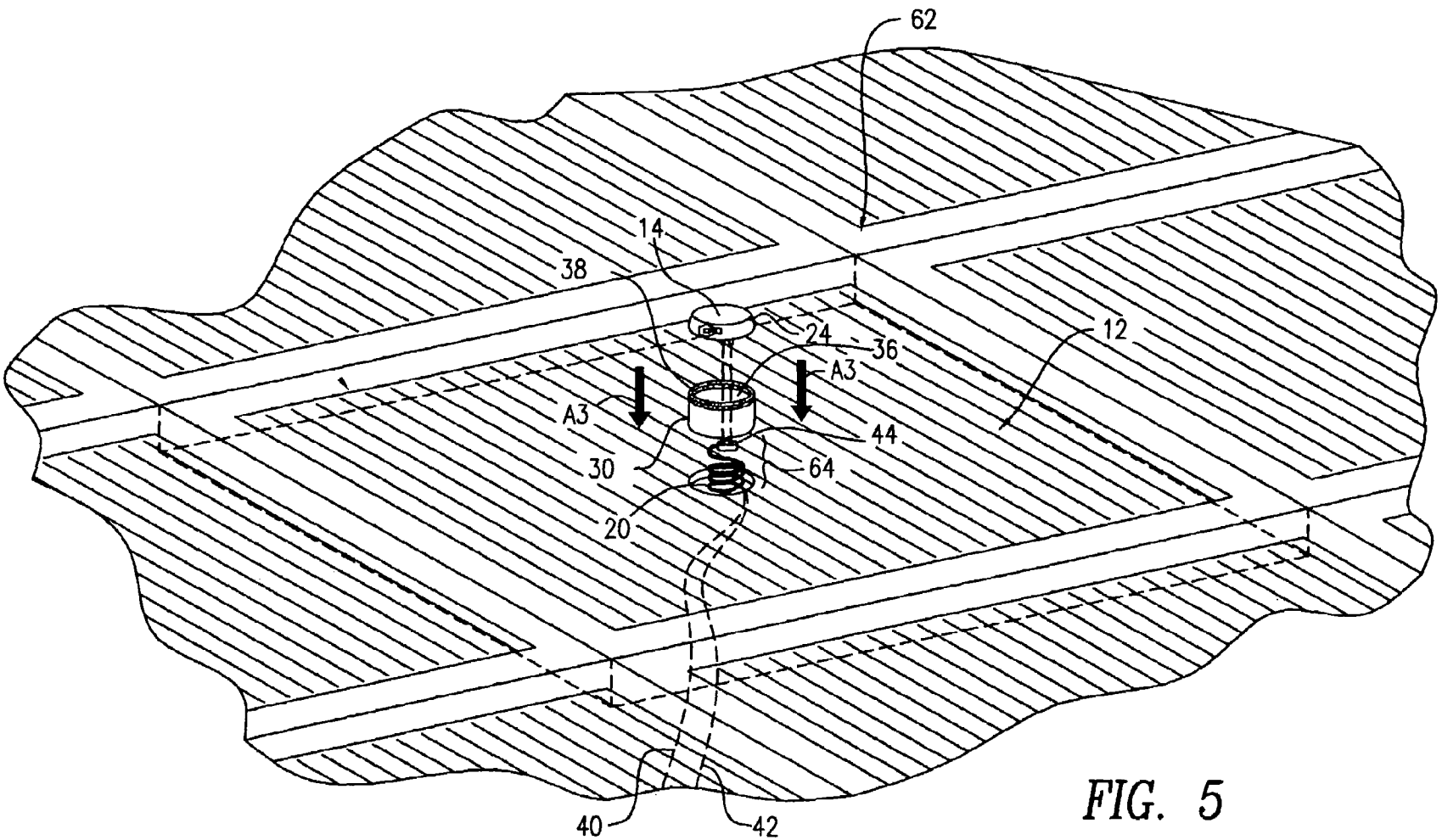

FIGS. 3, 4 and 5 show the sequential steps of one method of constructing the paver 10. More particularly, FIG. 3 shows the first step in the construction process, whereby a predetermined length of the wires 40, 42 is laid on a site 62 where the installation of the paver 10 is desired. An excess portion of the wires 40, 42 is rolled to form a coiled portion 64. The coiled portion 64 is placed in a location where the aperture 20 of the base 12 will be formed in order to accept the light assembly 14. A tube 66 is then placed over the coiled portion 64 of the wires 40, 42, as depicted by arrows A1.

Referring now to FIG. 4, after the tube 66 has been temporarily affixed in place, concrete is poured onto the site 62 and trowelled around the tube 66. The poured concrete cures and forms the base 12. It is noted that the tube 66 has generally the same outer wall diameter as the overall diameter of the support sleeve 30 to be installed within the base 12. The tube 66 may be formed of a metal or a plastic such as polyvinyl chloride (PVC). The length of the tube 66 depends upon the thickness of the base 12 to be formed. Generally, a tube 66 having a length of a couple of feet is sufficient. Once the tube 66 has been secured over the coiled portion 64 of the wires 40, 42, the base 12 may be formed.

While concrete is the preferred masonry product used to form the base 12, other masonry products may be used. Concrete is a preferred masonry material because of it's fast set up and cure time as well as it's inherent strength as a building material. Concrete is commonly used in the construction of driveways, walkways, staircases and patios.

It should be understood that the wires 40, 42 may be laid under the base 12 or embedded within it. Either method is acceptable, as concrete does not adversely affect the wires 40, 42 of their function. Once the concrete has set as shown in FIG. 4 to form the base 12, the tube 66 is removed from the base 12 by pulling up and out, as depicted by arrows A2, leaving the coiled section 64 of the wires 40, 42 exposed and resulting in the aperture 20.

Referring now to FIG. 5, after the base 12 has set and the tube 66 has been removed, the site 62 is ready for the installation of a the light assembly 14 and other components of the paver 10. The coiled portion 64 of the wires 40, 42 is taken out of the aperture 20 of the base 12, uncoiled and threaded through the cavity 36 of the support sleeve 30. The light assembly 14 is then connected to the socket 44 and a bead of adhesive 38 is placed between the first end 32 of the support sleeve 30 and the light assembly 14. Any slack in the wires 40, 42 is taken up by recoiling them and the coiled section 64 is placed inside the cavity 36 of the support sleeve 30, and the support sleeve 30 is placed into the aperture 20 of the base 12. Once inside the aperture 20, the light assembly 14 is positioned such that the lens cap 24 is flush with the exterior surface 16 of the base 12.

Figure 6:
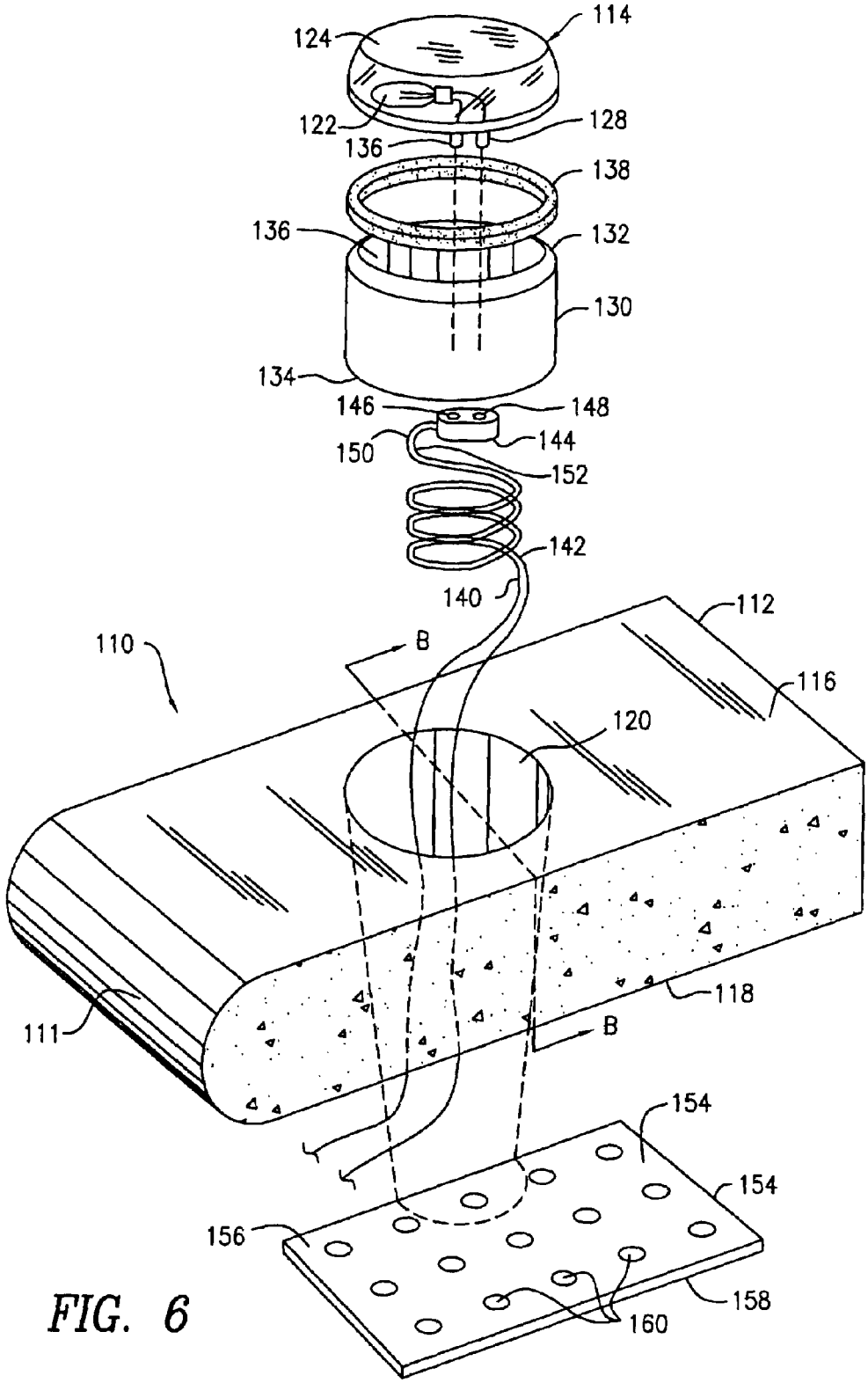
FIG. 6 is an exploded perspective view of a paver light in accordance with another exemplary embodiment of the present invention.
Figure 7:
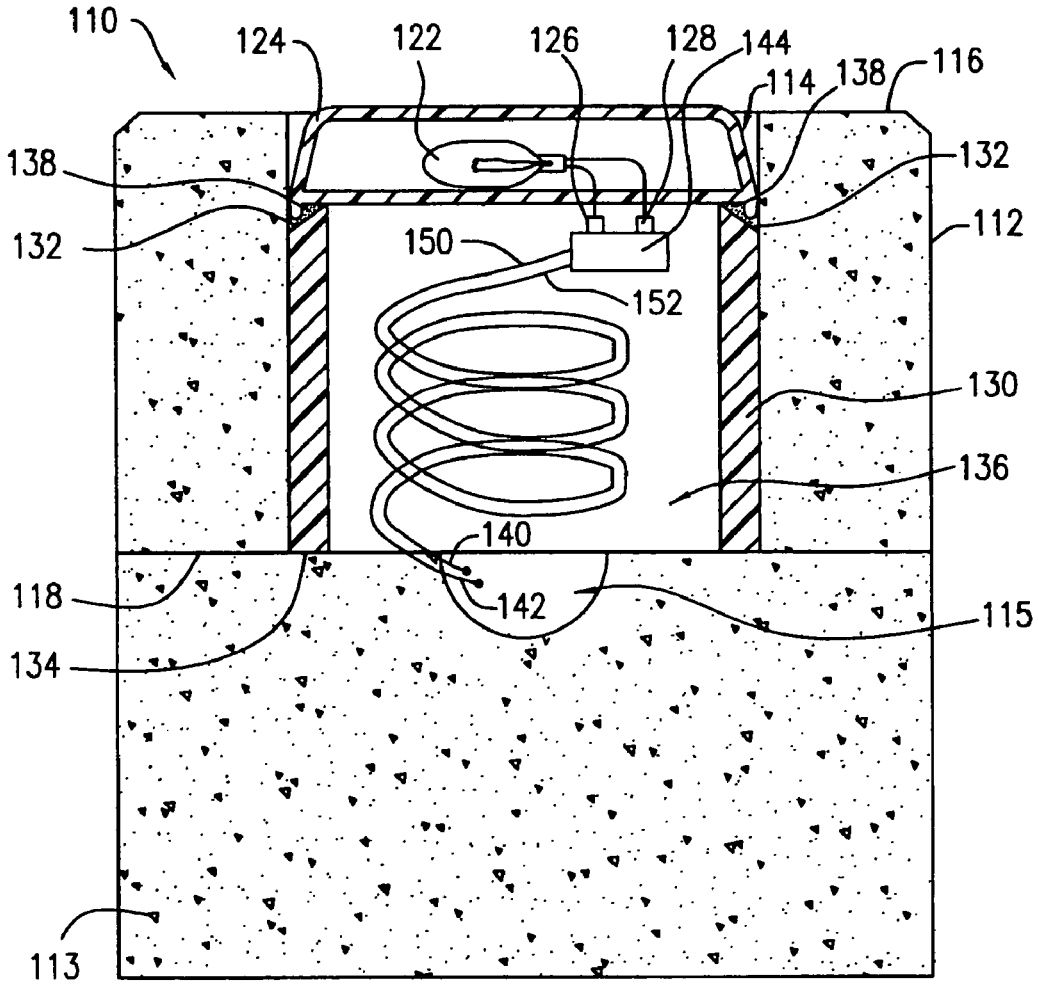
FIG. 7 is a cross-sectional view, taken along section line B—B and looking in the direction of the arrows, of the paver light shown in FIG. 6.

FIGS. 6 and 7 depict another exemplary embodiment of the present invention. Elements illustrated in FIGS. 6 and 7 that correspond, either identically or substantially, to the elements described above with respect to the embodiment shown in FIGS. 1 and 2 have been designated by corresponding reference numerals increased by one hundred (100). In addition, elements illustrated in FIGS. 6 and 7 that do not correspond to the elements described herein with reference to FIGS. 1 and 2 are designated by odd referenced numbers starting with reference numeral 111. Unless otherwise stated, the embodiment shown in FIGS. 6 and 7 is constructed and operates in the same basic manner as the embodiment shown in FIGS. 1 and 2.

Referring to FIGS. 6 and 7, a paver 110 includes a substantially rectangular brick-shaped base 112 and a disc-shaped modular light assembly 114, whose features and function shall be described hereinafter. The base 112 includes an exterior surface 116 and an interior surface 118 opposite the exterior surface 116. A circular-shaped aperture 120 extends longitudinally from the exterior surface 116 to the interior surface 118 of the base 112. The aperture 120 is sized and shaped to accommodate the receipt of the light assembly 114 and other components of the paver 110 within the base 112, which shall be identified and described in more detail below. The base 112 includes a rounded end 111, which enables the bullnose paver 110 to be utilized in the construction of outdoor masonry staircases and swimming pool coping.

Still referring to FIGS. 6 and 7, the light assembly 114 includes an incandescent bulb 122, a disc-shaped lens cap 124 which shields the bulb 122, and a pair of plug-like connectors 126, 128. The lens cap 124 is preferably waterproof and substantially transparent. Alternatively, the lens cap 124 can consist of different colors for aesthetic appeal. Preferably, the candlepower of the bulb 122 is sufficient to illuminate a driveway, walkway, patio or stairway in which the paver 110 is installed. Alternatively, other light sources, such as, for example, a light emitting diode ("LED") (not shown in FIGS. 6 and 7) may be used in place of the incandescent bulb 122.

Still referring to FIGS. 6 and 7, the paver 110 includes a tubular-shaped support sleeve 130 having a first end 132, a second end 134 opposite the first end 132, and a centrally located circular-shaped cavity 136 located between the first end 132 and the second end 134. The first end 132 of the support sleeve 130 is preferably tapered (as shown in FIGS. 6 and 7), but it need not be. The light assembly 114 is removably mounted to the first end 132 of the support sleeve 130 by an adhesive 138. The adhesive 138 may be, but is not limited to, materials commonly known in the art as "electricians putty" or "pavement adhesive", which, while providing a flexible watertight seal, may be removed if necessary. The support sleeve 130 is removably installed within the aperture 120 of the base 112 such that the first end 32 of the support sleeve 130 is recessed from the exterior surface 116 of the base 112 and the light assembly 114 is positioned proximate to the exterior surface 116 of the base 112.

Still referring to FIGS. 6 and 7, a pair of electrical wires 140, 142 passes under the interior surface 118 of the base 112 and enters the cavity 136 of the support sleeve 130. The wires 140, 142 supply low voltage current to the light assembly 114.

Referring specifically to FIG. 7, the bullnose paver 110 is shown laid on a solid block 113. The wires 132, 134 are positioned within a channel 115 formed across the solid block 113. The channel 115 may be formed using commonly available tools, such as chisels or saws.

Referring back to both FIGS. 6 and 7, a socket 144 having a pair of receptacles 146, 148 (not shown in FIG. 7, but see FIG. 6) is connected at one end 150 of the wire 140 and at one end 152 of the wire 142. Preferably, dielectric grease (not shown in FIGS. 6 and 7) is disposed on and around the receptacles 146, 148 to prevent corrosion of the socket 144. The connectors 126, 128 of the light assembly 114 mate respectively with the receptacles 138, 140 of the socket 144. The wires 140, 142 are preferably coiled inside the cavity 136 of the support sleeve 130. In this regard, the wires 140, 142 have a predetermined length that allows for the removal of the light assembly 114 and the socket 144 from the support sleeve 130 for the purposes of repair or replacement of the light assembly 114 externally of the base 112.

Referring now to FIG. 6, the paver 110 includes a rectangular-shaped support plate 154 having a first surface 156 and a second surface 158 opposite thereof. A plurality of circular-shaped holes 160 extend longitudinally from the first surface 156 to the second surface 158 of the plate 154. The first surface 156 of the plate 154 is juxtaposed with the second surface 118 of the base 112. More particularly, the plate 154 is positioned to one side of the aperture 120 of the base 112 (i.e., it is laterally offset relative to the aperture 120), rather than being positioned directly below the aperture 120 of the base 112 as in the embodiment of the paver 10 shown in FIGS. 1 and 2. Such offset positioning of the plate 154 is necessitated because, when the paver 110 is located over a void, the plate 154 must be relocated to span or be supported by a run of a staircase stringer (not shown in FIGS. 6 and 7) or other supportive medium.

It is noted that the plate 154 is preferably rectangular in shape, but it can consist of other shapes and sizes. While the aperture 120 of the base 112 and the cavity 136 of the support sleeve 130 are each preferably cylindrical in shape, it should be noted that each can consist of other shapes and sizes. Also, the holes 160 of the plate 154 are each preferably circular in shape, but each can consist of other shapes and sizes. In addition, the lens cap 124 is preferably disc-shaped, but it can consist of other shapes and sizes. Finally, the support sleeve 130 is preferably tubular in shape, but it can consist of other shapes and sizes.

It is also noted that the base 112 is preferably manufactured from a masonry material, such as poured concrete or fired clay type building brick. Alternatively, the base 112 can be manufactured from other materials. In addition, the lens cap 124 of the light assembly 114 is preferably made from high impact polycarbonate, but it can be made from other materials. The support plate 154 is preferably manufactured from a thin flexible corrosion resistant material, such as galvanized steel, or aluminum. Alternatively, the support plate 154 can be manufactured from other materials. Finally, the support sleeve 130 is preferably manufactured from PVC pipe, but it can be manufactured from other materials.

Moreover, a suitable light assembly 114 may be obtained commercially from Truck-Lite Inc., of Falconer, N.Y., model number 10, part number 10202. Alternatively, the light assembly 114 can be supplied by other manufacturers and/or be characterized by other model and part numbers.

In preparation for use of the paver 110, the light assembly 114 is connected to the socket 144 externally of the base 112. More particularly, the connector 126 of the light assembly 114 is connected to the receptacle 146 of the socket 144, while the connector 128 of the light assembly 114 is connected to the receptacle 148 of the socket 134. An end of the wire 140 opposite the end 150 thereof and an end of the wire 142 opposite the end 152 thereof are each connected to a power supply (not shown in FIGS. 6 and 7). The power supply has a preferable voltage of 12 volts, but it may have another voltage. Each of the wires 140, 142 are fed through one of the holes 160 of the support plate 154. Alternatively, the wires 140, 142 may be fed through an opening formed between an edge of the plate 154 and the aperture 120 of the base 112 (not shown in FIGS. 6 and 7).

The plate 156 acts as a stop to prevent the support sleeve 130 from being pressed into a bedding substrate (not shown in FIGS. 6 and 7) that the paver 110 is laid on, in the event that a force is applied directly on top of the light assembly 114. In turn, the light assembly 114 is prevented from traveling too far below the exterior surface 118 of the base 112; and, therefore, allows the light assembly 114 to support vertical loading.

Because the paver 110 is designed for installation within an area populated with other pavers, the light assembly 114 is configured to be removed from the base 112 without having to remove any of the other pavers (not shown in the Figures). More particularly, the light assembly 114 may be removed from the paver 110 with a common screwdriver or similar implement by simply prying the light assembly 114 out of the aperture 120 of the base 112. In this regard, the light assembly 114 can be quickly and easily disconnected from the socket 144 externally from the base 112 and replaced with a new light assembly 114 and reinstalled into the base 112. Furthermore, because the light assembly 114 is preferably manufactured as a sealed modular unit, replacement of the entire light assembly 114 is possible, thus gaining a new light source and housing.

Figure 8:
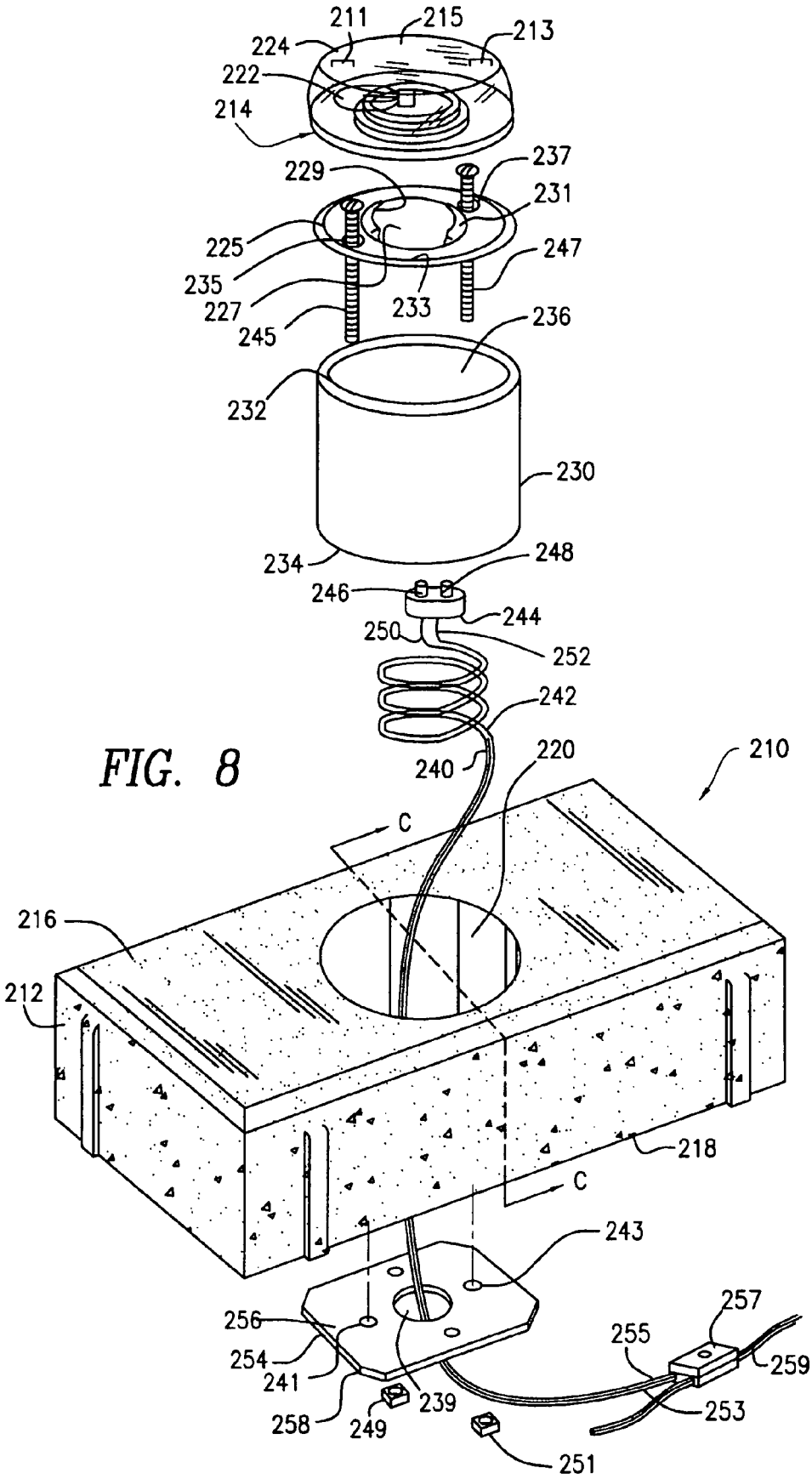
FIG. 8 is an exploded perspective view of a paver light in accordance with another exemplary embodiment of the present invention.
Figure 9:
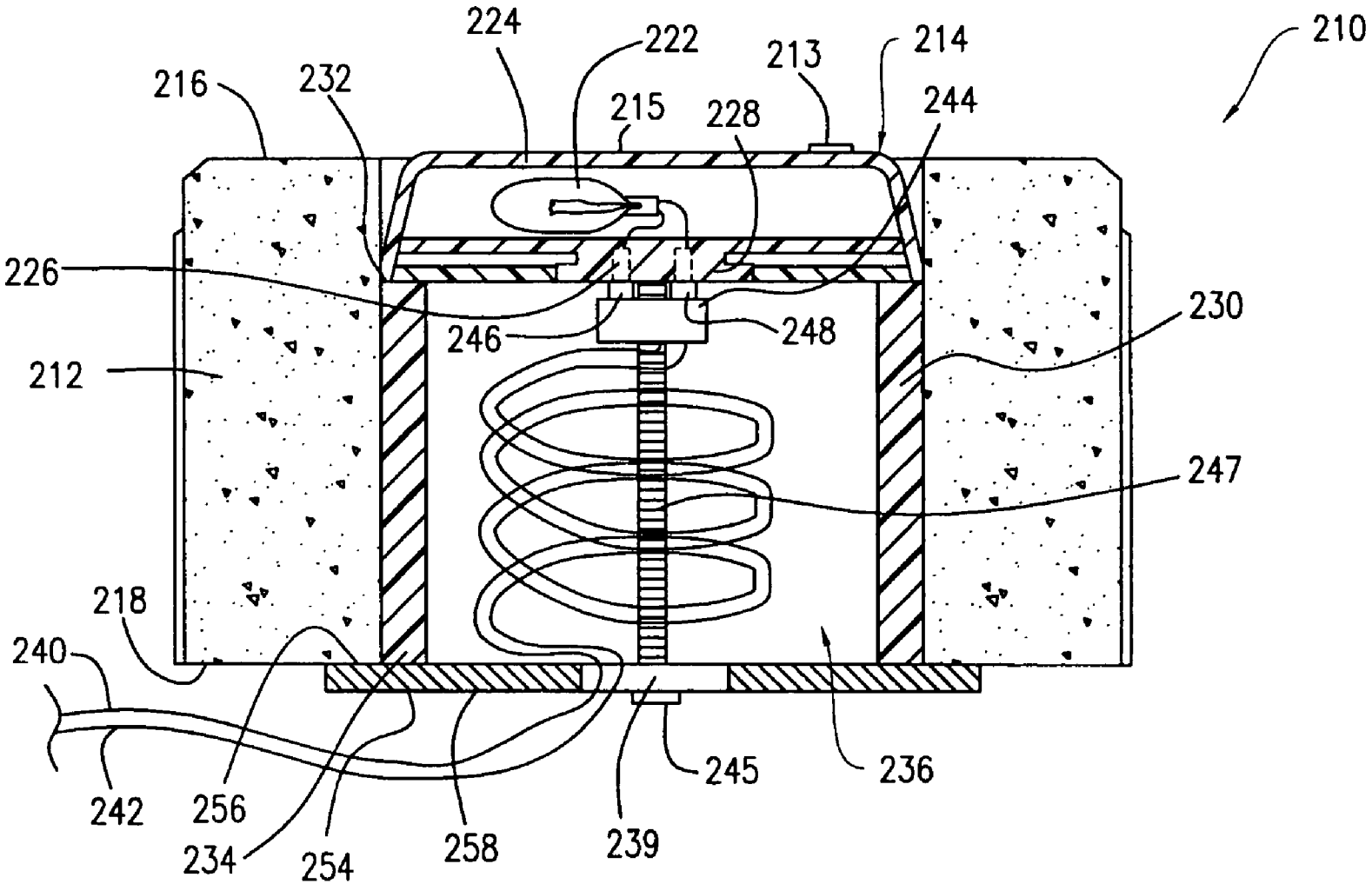
FIG. 9 is a cross-sectional view, taken along section line C—C and looking in the direction of the arrows, of the paver light shown in FIG. 8.
Figure 10:
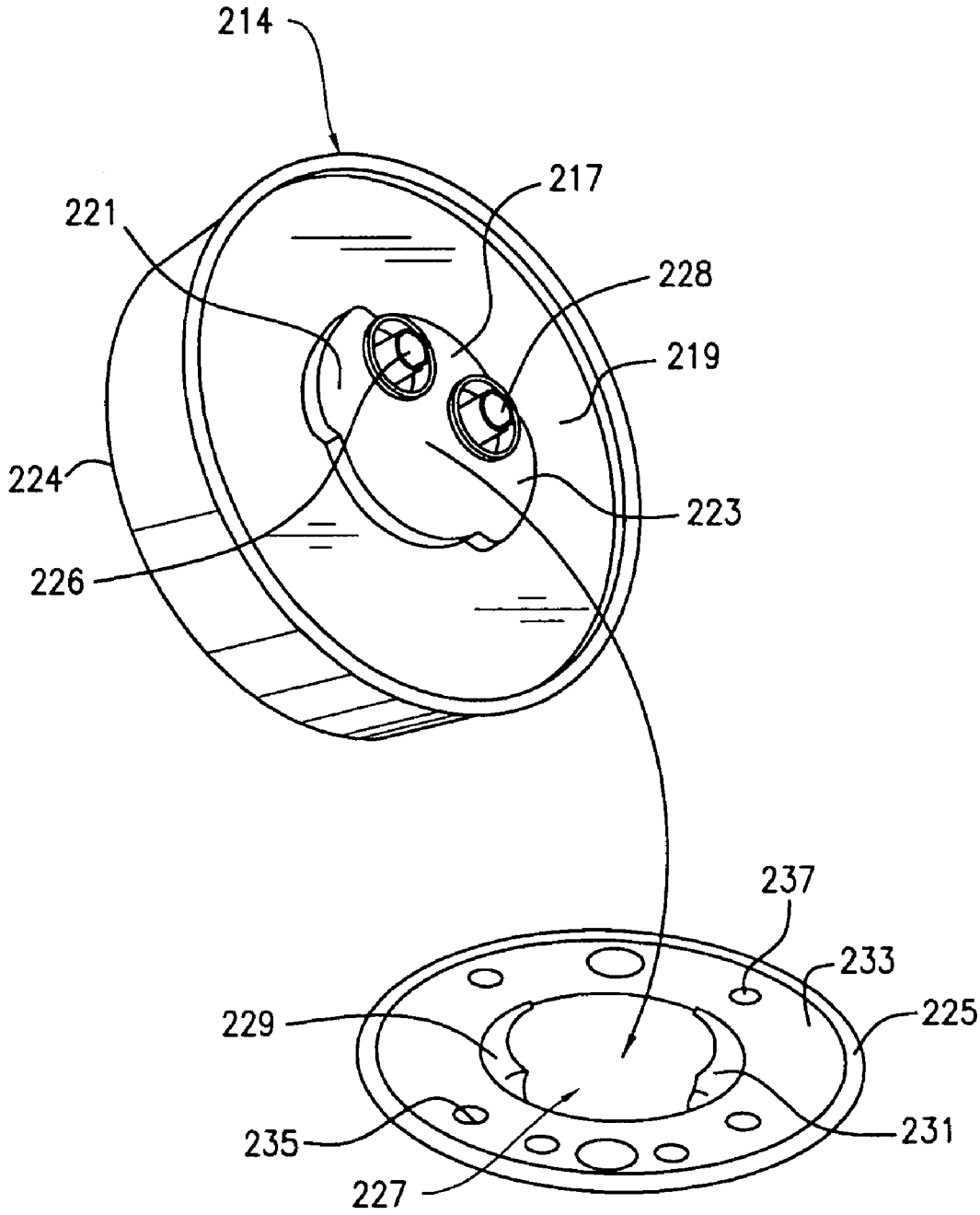
FIG. 10 is a bottom perspective view of a modular light assembly and a top perspective view of a corresponding mounting bracket employed by the paver light shown in FIGS. 8 and 9.

FIGS. 8, 9 and 10 depict another exemplary embodiment of the present invention. Elements illustrated in FIGS. 8, 9 and 10 that correspond, either identically or substantially, to the elements described above with respect to the embodiment shown in FIGS. 1 and 2 have been designated by corresponding reference numerals increased by two hundred (200). In addition, elements illustrated in FIGS. 8, 9 and 10 that do not correspond to the elements described herein with reference to FIGS. 1 and 2 are designated by odd reference numbers starting with reference numeral 211. Unless otherwise stated, the embodiment shown in FIGS. 8, 9 and 10 is constructed and operates in the same basic manner as the embodiment shown in FIGS. 1 and 2.

Referring to FIGS. 8 and 9, a paver 210 includes a rectangular-shaped base 212 and a light assembly 214, whose features and function shall be described hereinafter. The base 212 includes an exterior surface 216 and an interior surface 218 opposite the exterior surface 216. A circular-shaped aperture 220 extends longitudinally from the exterior surface 216 to the interior surface 218 of the base 212. The aperture 220 is sized and shaped to accommodate the receipt of the light assembly 214 and other components of the paver 210 within the base 212, which shall be identified and described in more detail below.

Referring now to FIGS. 8, 9 and 10, the light assembly 214 includes an incandescent bulb 222 and a disc-shaped lens cap 224 having a pair of diametrically opposed rectangular-shaped tabs 211, 213 that outwardly extend from a first surface of 215 of the lens cap 224. The function of the tabs 211, 213 shall be described hereinafter. The lens cap 224, which shields the bulb 222, is preferably waterproof and substantially transparent. Alternatively, the lens cap 224 can consist of different colors and/or can be modified to an opaque frosted finish (for instance, by sanding it with sandpaper) for aesthetic appeal. Preferably, the candlepower of the bulb 222 is sufficient to illuminate a driveway, walkway, patio or stairway in which the paver 210 is installed. Alternatively, other light sources, such as, for example, a light emitting diode ("LED") (not shown in FIGS. 8, 9 and 10) may be used in place of the incandescent bulb 222.

Referring now to FIG. 10, the light assembly 214 includes a cam lock 217 formed on a bottom surface 219 thereof. The cam lock 217 includes a pair of diametrically opposed tabs 221, 223 and a pair of plug-like connectors 226, 228 that outwardly extend from the cam lock 217. The function of the connectors 226, 228 and the cam lock 217 shall be described hereinafter.

Referring now to FIGS. 8 and 9, the paver 210 includes a tubular-shaped support sleeve 230 and a circular-shaped cam lock mounting bracket 225. The support sleeve includes a first end 232, a second end 234 opposite thereof, and a centrally located circular-shaped cavity 236 between the first end 232 and the second end 234 The bracket 225 includes a circular-shaped aperture 227, a pair of diametrically opposed locking tabs 229, 231 that are positioned about the periphery of the aperture 227 and outwardly extend from a first surface 233 of the bracket 225, and a pair of diametrically opposed circular-shaped screw holes 235, 237. The function of support sleeve 230 and the bracket 225 shall be described hereinafter.

Still referring to FIGS. 8 and 9, a pair of electrical wires 240, 242 passes under the second surface 218 of the base 212 and enters the cavity 236 of the support sleeve 230. The wires 240, 242 supply low voltage current to the light assembly 214. A socket 244 having a pair of receptacles 246, 248 is connected at one end 250 of the wire 240 and at one end 252 of the wire 242. Preferably, dielectric grease (not shown in FIGS. 8 and 9) is disposed on and around the receptacles 246, 248 to prevent corrosion of the socket member 244. The connectors 226, 228 of the light assembly 214 mate respectively with the receptacles 238, 240 of the socket 244. The wires 240, 242 are preferably coiled inside the cavity 236 of the support sleeve 230 in order to facilitate the removal of the light assembly 214 and the socket 244 from the support sleeve 230 for the purposes of repair or replacement of the light assembly 214 externally of the base 212.

Still referring to FIGS. 8 and 9, the paver 210 includes a square-shaped support plate 254 having a first surface 256 and a second surface 258 opposite thereof. A circular-shaped aperture 239 and a pair of circular-shaped holes 241, 243 each extend longitudinally from the first surface 256 to the second surface 258 of the plate 254. The first surface 256 of the plate 254 is juxtaposed with the second surface 218 of the base 212 and positioned proximate to the aperture 220 of the base 212.

In assembling the paver 210, a screw 245 is inserted into the hole 235 of the bracket 225, while a screw 247 is inserted into the hole 237 of the bracket 225. The bracket 225 is positioned on the first end 232 of the support sleeve 230, with the screws 245, 247 are positioned within the cavity 236 of the support sleeve 230. The support sleeve 230 and bracket 225 (as assembled in the foregoing manner) are fitted within the aperture 220 of the base 212, whereby the bracket 225 is positioned proximate to the exterior surface 216 of the base 212. An o-ring may be fitted around the exterior surface of the support sleeve 230 so as to promote centering of the support sleeve 230 within the aperture 220 of the base 212 (not shown in FIGS. 8 and 9). Alternatively, the o-ring need not be included.

Next, the plate 254 is positioned against the interior surface 218 of the base 212. The screw 245 is inserted in the hole 241 of the plate 254, while the screw 247 is inserted within the hole 243 of the plate. A threaded locknut 249 is fastened to the screw 245, while a threaded locknut 251 is fastened to the screw 247. The locknuts 249, 251 are tightened against the second surface 258 of the plate 254, thereby securing the bracket 225 to the first end 232 of the support sleeve 230, as well as securing the support sleeve 230 within the aperture 220 of the base 212.

It is noted that the bracket 225 and the support sleeve 230 are preferably two separate elements. Alternatively, the bracket 225 and the support sleeve 230 can be formed as a monolithic element, such that the first end 232 of the support sleeve 230 includes the features of the bracket 225, such as the locking tabs 229, 231.

It is further noted that the plate 256 acts as a stop to prevent the support sleeve 230 from being pressed into a bedding substrate (not shown in FIGS. 8 and 9) that the paver 210 is laid on, in the event that a force is applied directly on top of the light assembly 214. In turn, the light assembly 214 is prevented from traveling too far below the exterior surface 218 of the base 212; and, therefore, allows the light assembly 214 to support vertical loading.

Next, the connector 226 is connected to the receptacle 246 of the socket 244, while the connector 228 is connected to the receptacle 248 of the socket 244. The ends 250, 252 of the wires 240, 242 are fed through the aperture 239 of the support plate 254. An end 253 of the wire 240 opposite the end 250 thereof and an end of the wire 255 opposite the end 252 thereof are each connected to an insulation piercing connector 257 (not shown in FIG. 9, but see FIG. 8). In turn, the insulation piercing connector 257 is connected to a power cable 259 which is connected to a power source (not shown in the Figures). The connector 257 prevents moisture or oxidation from entering into the contact area of the power cable 259. In addition, the insulation piercing connector 257 allows a user to remove the paver 210 from one location to another location along the power cable 259. Preferably, the insulation piercing connector 257 is positioned underneath a paver block that is adjacent to the paver 210 (not shown in the Figures) so as not to interfere with the other components of the paver 210. It is also noted that the power source has a preferable voltage of 12 volts, but it may have another voltage.

Next, the light assembly 214 is mounted to the bracket 225. More particularly, the tabs 221, 223 of the cam lock 217 are aligned between the locking tabs 229, 231 of the bracket 225 and the light assembly 214 is then twisted a one-quarter turn (i.e., 90 degrees) clockwise. As a result, the tabs 221, 223 of the cam lock of the light assembly 214 engage the locking tabs 229, 231 of the bracket 225, thereby securing the light assembly 214 to the bracket 225 and, in turn, to the support sleeve 230. The light assembly 214 can be easily and quickly removed for repair or replacement by twisting it one-quarter turn (i.e., 90 degrees) counter-clockwise. As a result, the tabs 221, 223 of the cam lock of the light assembly 214 disengage the locking tabs 229, 231 of the bracket 225, thereby facilitating the removal of the light assembly 214 from the bracket 225 and, in turn, from the support sleeve 230. The tabs 211, 213 of the lens cap 224 function as leverage points to facilitate the installation and removal of the light assembly 214 from the bracket 225 by a user with a special shaped key or another tool, such as a screwdriver. Although it is preferable that the lens cap 224 of the light assembly 214 includes the tabs 211, 213, they need not be included. Alternatively, the lens cap 224 may include other means for leverage to facilitate the removal of the light assembly 214 from the bracket 225, such as, for instance, recesses formed therein (not shown in the Figures).

It is noted that the base 212 preferably has a rectangular-brick shape, but it can consist of other shapes and sizes. The plate 254 is preferably square in shape, but each can consist of other shapes and sizes. While the aperture 220 of the base 212, the cavity 236 of the support sleeve 230, and the aperture 235 and the holes 237, 239 of the plate 254 are each preferably circular in shape, it should be noted that each can consist of other shapes and sizes. In addition, the lens cap 224 of the light assembly 214 and the bracket 225 are each preferably disc-shaped, but each can consist of other shapes and sizes. Finally, the support sleeve 230 is preferably tubular in shape, but it can consist of other shapes and sizes.

It is also noted that the base 212 is preferably manufactured from a masonry material, such as poured concrete or fired clay type building brick. Alternatively, the base 212 can be manufactured from other materials. In addition, the lens cap 224 of the light assembly 214 is preferably made from high impact polycarbonate, such as, for instance, from LEXAN® brand of polycarbonate. Alternatively, the lens cap 224 can be made from other materials. The mounting bracket 225, the screws 245, 247 and the locknuts 249, 251 are each preferably made from stainless steel, but each can be made from other materials. The support plate 254 is preferably manufactured from a thin flexible corrosion resistant material, such as galvanized steel, or from aluminum. Alternatively, the support plate 254 can be manufactured from other materials. Finally, the support sleeve 230 is preferably manufactured from PVC pipe, but it can be manufactured from other materials.

Moreover, a kit including the modular light assembly 214, the socket 244 and the bracket 225 may be obtained commercially from Truck-Lite Inc., of Falconer, N.Y., model number 10400. Alternatively, the light assembly 114, the socket 244 and the bracket 225 can be supplied by other manufacturers and/or be characterized by other model and part numbers. In addition, the insulation piercing connector 257 may be obtained commercially from Hadco, Inc. of Littlestown, Pa., part number LVC3. Alternatively, the connector 257 can be supplied by other manufacturers and/or be characterized by other model and part numbers. Also, the wires 240, 242 can be SPT-1W wire, but they can consist of other types of wire.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A lighting fixture for a masonry structure, comprising a support member having a first end, a second end opposite said first end, an internal cavity between said first and second ends, and at least one cam lock tab, said support member being sized and shaped for insertion within an aperture of the masonry structure such that said first end of said support member is proximate to an exterior surface of the masonry structure; an electrical socket removably received within said cavity of said support member; a sealed modular light assembly, including a self-contained light source and a cam lock, said modular light assembly being removably mounted to and substantially covering said first end of said support member, said cam lock and said at least one cam lock tab of said support member being sized and shaped such that said cam lock and said at least one cam lock tab are releasably engageable with one another by turning said modular light assembly relative to said support member; first connecting means on said modular light assembly; and second connecting means on said socket, said first and second connecting means being releasably engageable with each other so as to mechanically and electrically connect said modular light assembly to said socket such that said socket is removable from said cavity of said support member in response to the removal of said modular light assembly from said first end of said support member, whereby, after removing said modular light assembly from said first end of said support member, said modular light assembly can be mechanically and electrically disconnected from said socket externally of the masonry structure for the purposes of repair or replacement.

2. The lighting fixture as claimed in claim 1, further comprising at least one electrical wire having a first end and a second end opposite thereof, said first end of said wire being electrically connected to said socket and said second end of said wire being electrically connected to an external power source, said wire having a predetermined length to allow said socket to be removed from said cavity of said support member as said modular light assembly is removed from said first end of said support member.

3. The lighting fixture as claimed in claim 1, wherein said modular light assembly includes shielding means for shielding said light source of said modular light assembly from external objects.

4. The lighting fixture as claimed in claim 3, wherein said shielding means includes a lens cap.

5. The lighting fixture as claimed in claim 4, wherein said light source of said modular light assembly includes an incandescent bulb.

6. The lighting fixture as claimed in claim 4, wherein said light source of said modular light assembly includes a light emitting diode.

7. The lighting fixture as claimed in claim 1, wherein said support member includes a mounting bracket mounted to said first end of said support member, said mounting bracket being adapted to releasably receive said modular light assembly.

8. The lighting fixture as claimed in claim 1, wherein said first connecting means of said modular light assembly includes at least one connector, and said second connecting means of said socket includes at least one receptacle.

9. The lighting fixture as claimed in claim 1, wherein said modular light assembly and said support member are releasably engageable with one another by turning said modular light assembly approximately ninety degrees relative to said support member.

10. In combination, a masonry structure, comprising an exterior surface, an interior surface opposite said exterior surface, and an aperture formed within said exterior surface; and a lighting fixture, comprising a support member having a first end, a second end opposite said first end, an internal cavity between said first and second ends, and at least one cam lock tab, said support member being sized and shaped for insertion within said aperture of said masonry structure such that said first end of said support member is proximate to said exterior surface of said masonry structure; an electrical socket removably received within said cavity of said support member; a sealed modular light assembly, including a self-contained light source and a cam lock, said modular light assembly being removably mounted to and substantially covering said first end of said support member, said cam lock and said at least one cam lock tab of said support member being sized and shaped such that said cam lock and said at least one cam lock tab are releasably engageable with one another by turning said modular light assembly relative to said support member; first connecting means on said modular light assembly; and second connecting means on said socket, said first and second connecting means being releasably engageable with each other so as to mechanically and electrically connect said modular light assembly to said socket such that said socket is removable from said cavity of said support member in response to the removal of said modular light assembly from said first end of said support member, whereby, after removing said modular light assembly from said first end of said support member, said modular light assembly can be mechanically and electrically disconnected from said socket externally of said masonry structure for the purposes of repair or replacement.

11. The combination as claimed in claim 10, wherein said lighting fixture further comprises at least one electrical wire having a first end and a second end opposite said first end, said first end of said wire being electrically connected to said socket and said second end of said wire being electrically connected to an external power source, said wire having a predetermined length to allow said socket to be removed from said cavity of said support member as said modular light assembly is removed from said first end of said support member.

12. The combination as claimed in claim 10, wherein said modular light assembly includes shielding means for shielding said light source of said modular light assembly from external objects.

13. The combination as claimed in claim 12, wherein said shielding means includes a lens cap.

14. The combination as claimed in claim 13, wherein said light source of said modular light assembly includes an incandescent bulb.

15. The combination as claimed in claim 13, wherein said light source of said modular light assembly includes a light emitting diode.

16. The combination as claimed in claim 13, wherein said aperture of said masonry structure extends from said exterior surface to said interior surface of said masonry structure.

17. The combination as claimed in claim 16, wherein said aperture of said masonry structure has a cylindrical shape with a substantially constant diameter from said exterior surface to said interior surface of said masonry structure.

18. The combination as claimed in claim 17, further comprising inhibiting means, positioned proximate to said aperture of said masonry structure at said interior surface of said masonry structure, for inhibiting said support member from exiting said aperture at said interior surface of said masonry structure.

19. The combination as claimed in claim 18, wherein said inhibiting means includes a substantially flat plate, said plate substantially obstructing said aperture, and said second end of said support member engages said plate.

20. The combination as claimed in claim 19, wherein said lens cap of said modular light assembly is positioned substantially flush with said exterior surface of said masonry structure.

21. The combination as claimed in claim 10, wherein said support member includes a mounting bracket mounted to said first end of said support member, said mounting bracket being adapted to releasably receive said modular light assembly.

22. The combination as claimed in claim 10, wherein said masonry structure is a paver block.

23. The lighting fixture as claimed in claim 10, wherein said first connecting means of said modular light assembly includes at least one connector, and said second connecting means of said socket includes at least one receptacle.

24. The lighting fixture as claimed in claim 10, wherein said modular light assembly and said support member are releasably engageable with one another by turning said modular light assembly approximately ninety degrees relative to said support member.

25. A method for installing and replacing a lighting fixture, which is mounted in an aperture of a masonry structure, comprising the steps of:

inserting a support member having at least one cam lock tab into said aperture of said masonry structure such that one end of said support member is proximate to an exterior surface of said masonry structure;

mechanically and electrically connecting a socket to a sealed modular light assembly having a self-contained light source and a cam lock, said connecting step being carried out externally of said masonry structure;

mounting said modular light assembly to said one end of said support member by turning said modular light assembly relative to said support member such that said cam lock of said modular light assembly and said at least one cam lock tab of said support member releasably engage each other, said socket is positioned within said aperture of said masonry structure;

removing said modular light assembly from said one end of said support member by turning said modular light assembly relative to said support member such that said modular light assembly and said socket are positioned externally of said masonry structure;

mechanically and electrically disconnecting said modular light assembly from said socket; and mechanically and electrically connecting another modular light assembly to said socket.

* * * * *